US005575356A

United States Patent [19]

Chen et al.

[11] Patent Number: 5,575,356

[45] Date of Patent: Nov. 19, 1996

[54] LIFT

[76] Inventors: Meu S. Chen; George Chen, both of P.O. Box 82-144, Taipei, Taiwan

[21] Appl. No.: 499,774

[22] Filed: Jul. 7, 1995

[51] Int. Cl.[6] ..... B66B 9/00

[52] U.S. Cl. ..... 187/239; 187/403

[58] Field of Search ..... 187/403, 406, 187/410, 239, 900; 182/82, 141, 142

[56] References Cited

U.S. PATENT DOCUMENTS

| | | | |
|---|---|---|---|
| 1,541,144 | 6/1925 | Holmes | 187/403 |
| 2,236,019 | 3/1941 | Thompson | 187/239 |

FOREIGN PATENT DOCUMENTS

| | | | |
|---|---|---|---|
| 275590 | 3/1990 | Japan | 187/403 |

*Primary Examiner*—Kenneth Noland
*Attorney, Agent, or Firm*—Alfred Lei

[57] ABSTRACT

A lift including a rectangular base frame moved between two parallel rails on the outside wall of a building, two supporting bars fastened to the base frame for holding the cargo, a lifting cable driven by a motor drive to lift the base frame along the parallel rails, wherein the supporting bars are hinged to a cross bottom bar on the base frame and turned between the collapsed position in which the supporting bars are longitudinally aligned and closely attached to said cross bottom bar, and the operative position in which the supporting bars are disposed in parallel with each other and perpendicular to the cross bottom rail for supporting the wheels of a cargo carriage upon its loading onto the lift, the supporting bars each having an upright guard rod at the end for stopping the cargo carriage in place.

6 Claims, 4 Drawing Sheets

LIFT

BACKGROUND OF THE INVENTION

1. Field of the Invention

The present invention relates to lifts for use in buildings to lift things between the floors, and relates more particularly to such a lift which can be collapsed when not in use.

2. Description of the Prior Art

In factories, plants, warehouses, etc., lifts may be installed for lifting cargoes from one floor to another. These lifts commonly comprises a hoistway in the building, a cage moved in the hoistway, a motor drive, and a lifting cable driven by the motor drive to lift the cage in the hoistway. This structure of lift needs much installation space, therefore it is not suitable for use in a narrow area.

SUMMARY OF THE INVENTION

The present invention has been accomplished to provide a lift which eliminates the aforesaid drawback. It is one object of the present invention to provide a lift which is collapsible. It is another object of the present invention to provide a lift which needs less installation space. It is still another object of the present invention to provide a lift which can be installed outside the building. It is still another object of the present invention to provide a lift which is designed to carry the cargo carriage with the load. According to the present invention, the lift comprises a rectangular base frame moved between two parallel rails on the outside wall of a building, two supporting bars fastened to the base frame for holding the cargo, a lifting cable driven by a motor drive to lift the base frame along the parallel rails, wherein the supporting bars are hinged to a cross bottom bar on the base frame and turned between the collapsed position in which the supporting bars are longitudinally aligned and closely attached to said cross bottom bar, and the operative position in which the supporting bars are disposed in parallel with each other and perpendicular to the cross bottom rail for supporting the wheels of a cargo carriage upon its loading onto the lift, the supporting bars each having an upright guard rod at the end for stopping the cargo carriage in place.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
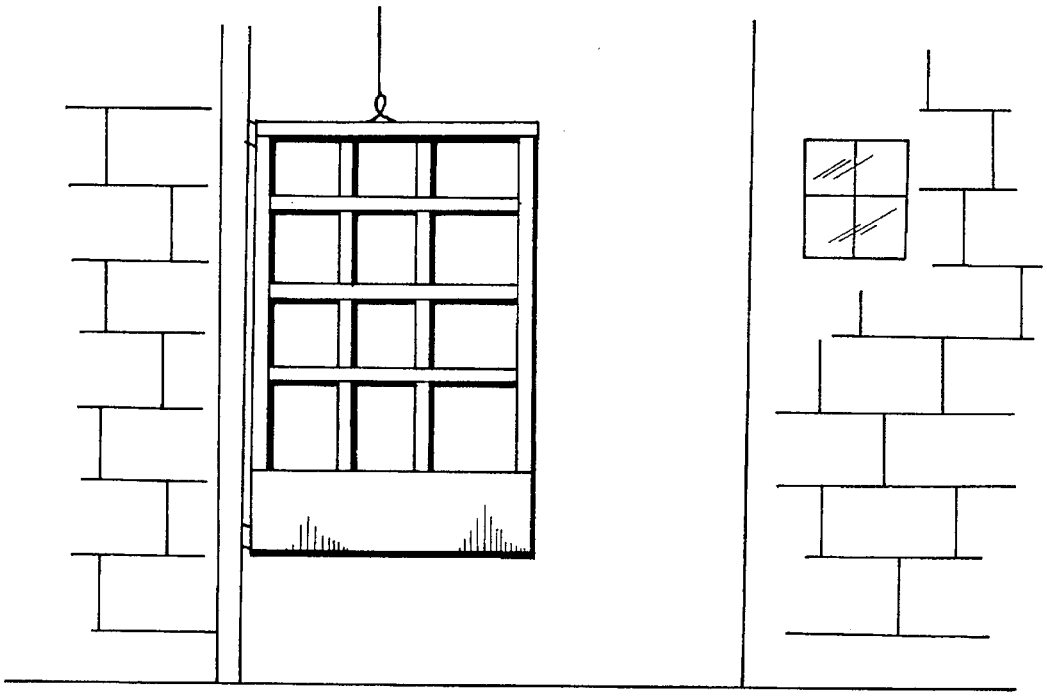
PRIOR ART FIG. 1
FIG. 1 shows a lift according to the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
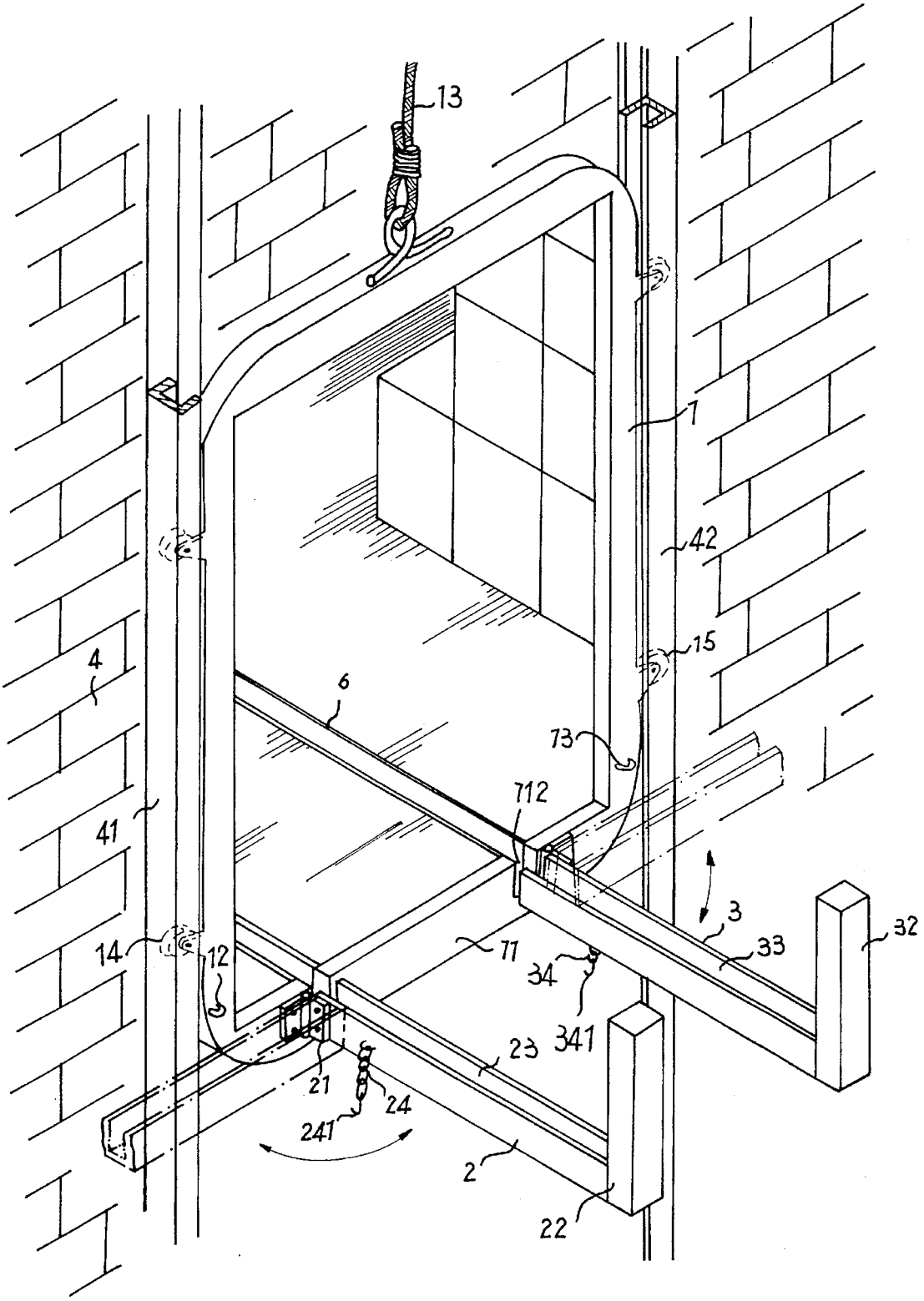
FIG. 2 is a perspective elevational view of a lift according to the present invention.

Referring to FIG. 2, a lift in accordance with the present invention is generally comprised of a rectangular base frame 1, and two supporting bars 2 and 3. The supporting bars 2 and 3 are respectively and bilaterally hinged to the bottom cross bar 11 of the base frame 1 by hinges 21 and 31. Therefore, the supporting bars 2 and 3 can be turned between the collapsed position in which the supporting bars 2 and 3 are longitudinally aligned, and the operative position in which the supporting bars 2 and 3 are disposed in parallel with each other and perpendicular to the cross bar 11. The supporting bars 2 and 3 have a respective free end terminating in an upright guard rod 22 or 32. The cross bar 11 has two openings 111 and 112, which are respectively aligned with the longitudinal grooves 23 and 33 of the supporting bars 2 and 3 when the supporting bars 2 and 3 are moved to the operative position. The base frame 1 has a plurality of rollers 14 and 15 at two opposite sides moved between two parallel rails 41 and 42 on the outside wall 4 of the building. A lifting cable 13 is fastened to the base frame 1 and driven by a motor drive (not shown) to lift the base frame 1. Two chains 24 and 34 are respectively and fixedly secured to the supporting bars 2 and 3 at an outer side, each terminating in a hook 241 or 341. The base frame 1 further comprises two locating rings 12 and 13 at two opposite sides for hanging the hooks 241 and 341 of the chains 24 and 34 respectively.

Figure 3:
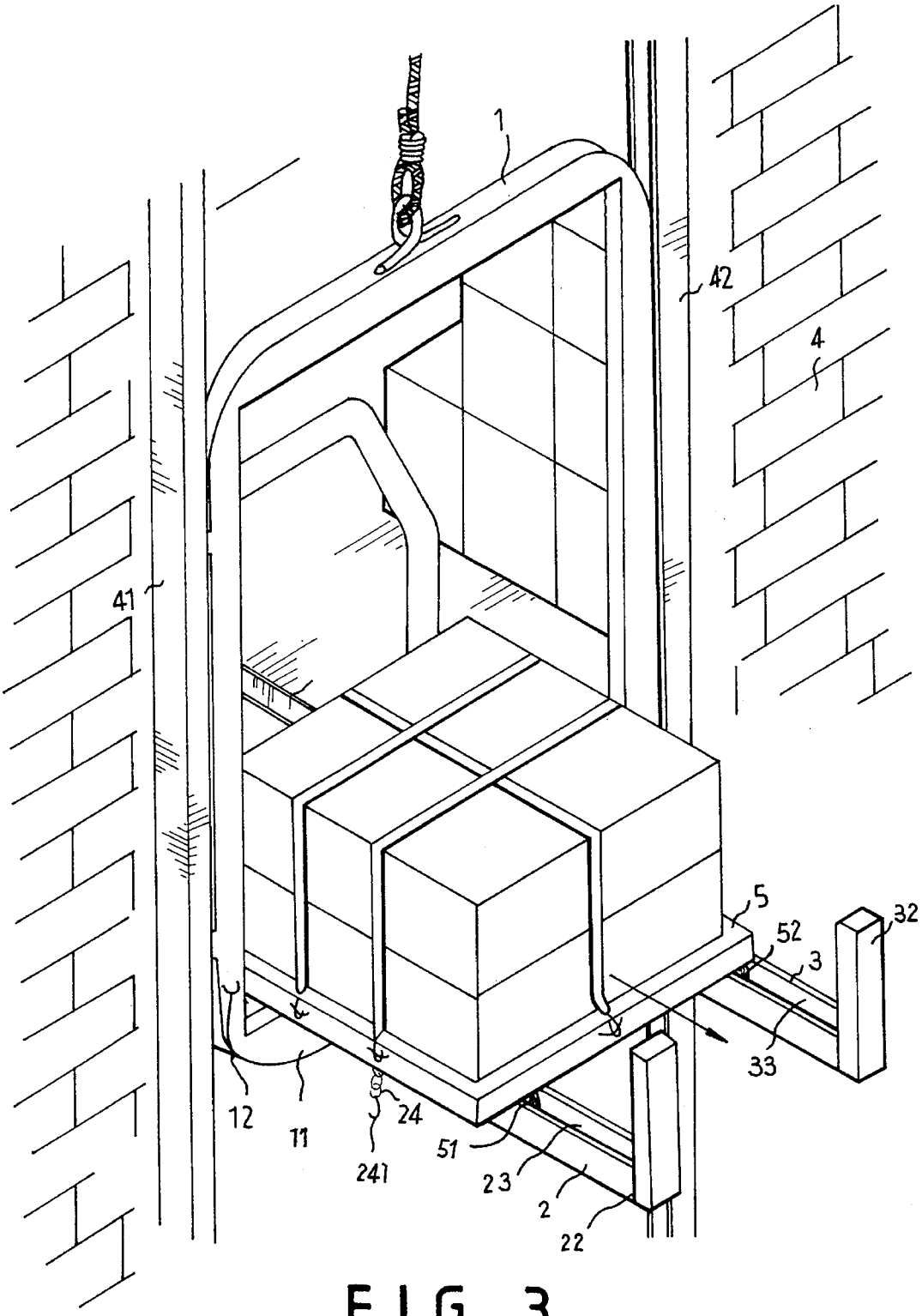
FIG. 3 is an applied view of the present invention, showing the lift operated.

Referring to FIG. 3 and FIG. 2 again, when the supporting bars 2 and 3 are moved to the operative position, the wheels 52 of the cargo carriage 5 can be moved from the rails 6 on each floor of the building through the openings 111 and 112 of the cross bar 11 of the base frame 1 into the longitudinal grooves 23 and 33 of the supporting bars 2 and 3. When the cargo carriage 5 is moved to the supporting bars 2 and 3, it is stopped at the upright guard rods 22 and 32, and the lift is lifted by the lifting cable 13 to move the cargo carriage 5 with its load to the desired floor in the building. A spare cargo carriage may be prepared at each floor so that the cargo carriage which carries the load can be directly moved out of the lift and then the spare cargo carriage can be moved into the lift for carrying things.

Figure 4:
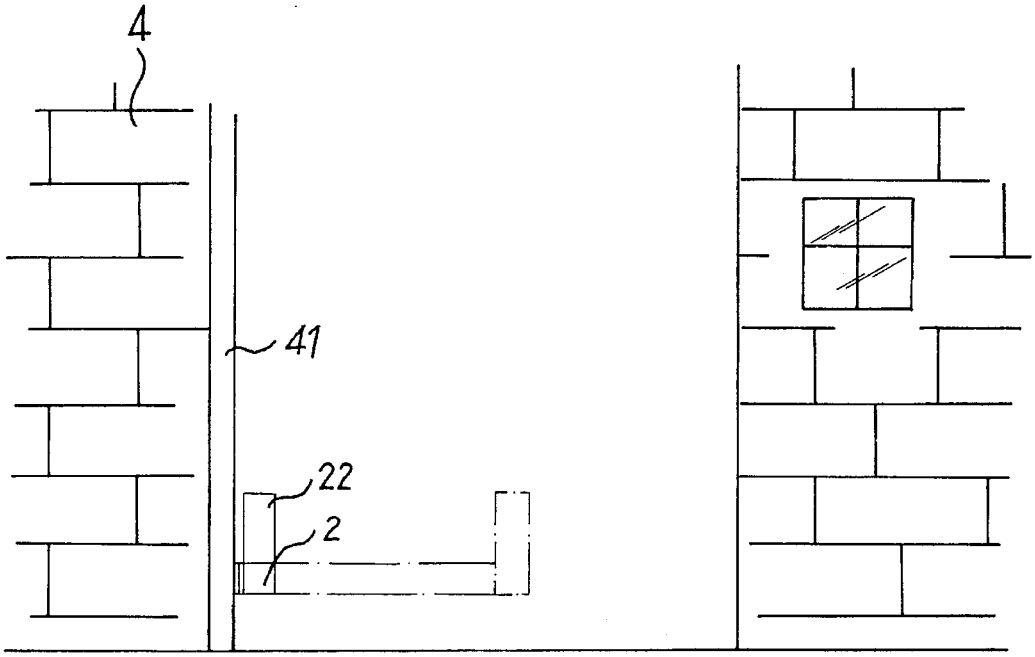
FIG. 4 is a side plain view showing the lift collapsed according to the present invention.

Referring to FIG. 4 and FIG. 2 again, when the lift is not in use, the supporting bars 2 and 3 are turned to the collapsed position, and the hooks 241 and 341 of the chains 24 and 34 are respectively hooked on the locating rings 12 and 13 to hold the supporting bars 2 and in the collapsed position.

Figure 5A:
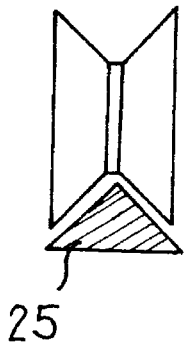
FIG. 5A is a cross sectional view of the supporting bar according to the present invention.
Figure 5B:
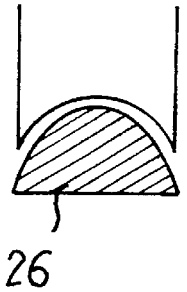
FIG. 5B is a cross sectional view of an alternate form of the supporting bar according to the present invention.
Figure 5C:
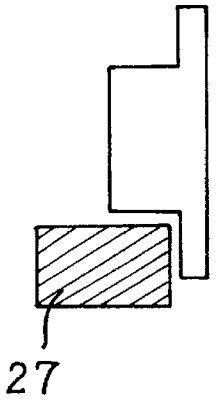
FIG. 5C is a cross sectional view of another alternate form of the supporting bar according to the present invention.

Referring to FIGS. 5A, 5B, and 5C, the supporting bars 2 and 3 may be variously embodied to fit different wheels of the cargo carriage. For example, the supporting bars 2 and 3 may define a respective longitudinal track of triangular cross section 25 as shown in FIG. 5A, a respective longitudinal track of half-round cross section 26 as shown in FIG. 5B, or a respective longitudinal track of rectangular cross section 27 as shown in FIG. 5C.

It is to be understood that the drawings are designed for purposes of illustration only, and are not intended as a definition of the limits and scope of the invention disclosed. For example, the movement of the supporting bars 2 and 3 relative to the cross bar 11 may be controlled by a hydraulic cylinder through a control switch. Alternatively, the supporting bars 2 and 3 may be directly and perpendicularly welded to the cross bar 11 of the base frame 1.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A lift comprising a rectangular base frame moved between two parallel rails on the outside wall of a building, two supporting bars fastened to said base frame for carrying things, a lifting cable fastened to said base frame and driven by a motor drive to lift said base frame along said parallel rails, wherein said supporting bars are hinged to a cross bottom bar on said base frame and turned between the collapsed position in which said supporting bars are longitudinally aligned and closely attached to said cross bottom bar, and the operative position in which said supporting bars are disposed in parallel with each other and perpendicular to said cross bottom rail for supporting the wheels of a cargo carriage, said supporting bars each having an upright guard rod at the end for supporting the cargo carriage in place.

2. The lift of claim 1 wherein further comprising fastener means to fasten said supporting bars in the collapsed position.

3. The lift of claim 2 wherein said fastener means comprises two locating rings mounted on said base frame at two opposite sides, and two chains respectively and fixedly secured to said supporting bars, each chain having a free end terminating in a hook for hooking on one locating ring.

4. The lift of claim 1 wherein said supporting bars define a respective longitudinal track of triangular cross section for supporting the wheels of a cargo carriage.

5. The lift of claim 1 wherein said supporting bars define a respective longitudinal track of half-round cross section for supporting the wheels of a cargo carriage.

6. The lift of claim 1 wherein said supporting bars define a respective longitudinal track of rectangular cross section for supporting the wheels of a cargo carriage.

* * * * *